US006089073A

United States Patent [19]

Baur

[11] Patent Number: 6,089,073

[45] Date of Patent: Jul. 18, 2000

[54] DRAWING APPARATUS WITH BLOCKING DEVICES, DETENTS AND THE LIKE

[75] Inventor: Siegfried Baur, Goeppingen, Germany

[73] Assignee: Schuler Pressen GmbH & Co. KG, Goeppingen, Germany

[21] Appl. No.: 09/104,241

[22] Filed: Jun. 25, 1998

[30] Foreign Application Priority Data

Jun. 25, 1997 [DE] Germany ..... 197 26 928

[51] Int. Cl.[7] ..... B21D 24/16

[52] U.S. Cl. ..... 72/441; 100/53

[58] Field of Search ..... 72/350, 351, 441, 72/453.13; 100/219, 53

[56] References Cited

U.S. PATENT DOCUMENTS

| | | | |
|---|---|---|---|
| 2,240,630 | 5/1941 | Stacy | 100/53 |
| 2,357,508 | 9/1944 | Ernst | 100/53 |
| 2,653,560 | 9/1953 | Bradhering | 100/53 |
| 4,712,412 | 12/1987 | Roos et al. | 72/453.13 |
| 5,099,673 | 3/1992 | Baur | 72/351 |

FOREIGN PATENT DOCUMENTS

| | | |
|---|---|---|
| 0 673 695 | 9/1995 | European Pat. Off. . |
| 44 03 954 | 8/1995 | Germany . |

*Primary Examiner*—Lowell A. Larson
*Attorney, Agent, or Firm*—Evenson, McKeown, Edwards & Lenahan, P.L.L.C.

[57] ABSTRACT

A drawing apparatus in a press or similar forming system has a blank holder which can be acted upon by one or optionally several pressure cylinders. Blocking devices are provided which act, in one case, directly upon a pressure cheek supporting the blank holder and, in another case, indirectly upon the pressure cheek by way of an articulated train or transmission train. Thereby, an unintentional lifting or lowering of the blank holder is prevented when the press is inoperative.

3 Claims, 9 Drawing Sheets

DRAWING APPARATUS WITH BLOCKING DEVICES, DETENTS AND THE LIKE

BACKGROUND OF THE INVENTION

This application claims the priority of German application 197 26 928.1, filed in Germany on Jun. 25, 1997, the disclosure of which is expressly incorporated by reference herein.

The present invention relates to a drawing apparatus in a press or similar forming system, having a one-part or two-part blank holder and at least one pressure cylinder for the counterholding during the drawing and ejecting of the formed workpiece.

For preventing danger to operating personnel working in the tool area, training presses, for example, must block the movement of the pressure cheek and thus of the blank holder(s) during press stoppage. For this purpose, hydraulic circuits have been used which, however, cannot ensure absolute safety. For example, a soiling of the seat valves cannot be excluded so that the pressure cheek of the drawing apparatus and thus the blank holder which is accessible on the outside will start to move.

SUMMARY OF THE INVENTION

An object of the present invention is to stop the pressure cheek of the drawing apparatus and therefore the blank holder, as required, in any position and at any level.

This object has been achieved by blocking devices, detents and the like which, in one case, act directly onto the pressure cheek supporting the blank holder and, in the other case, act indirectly onto the pressure cheek by way of an articulated train or gearing train.

Other objects, advantages and novel features of the present invention will become apparent from the following detailed description of the invention when considered in conjunction with the accompanying drawings.

DETAILED DESCRIPTION OF THE DRAWINGS

Figure 1:
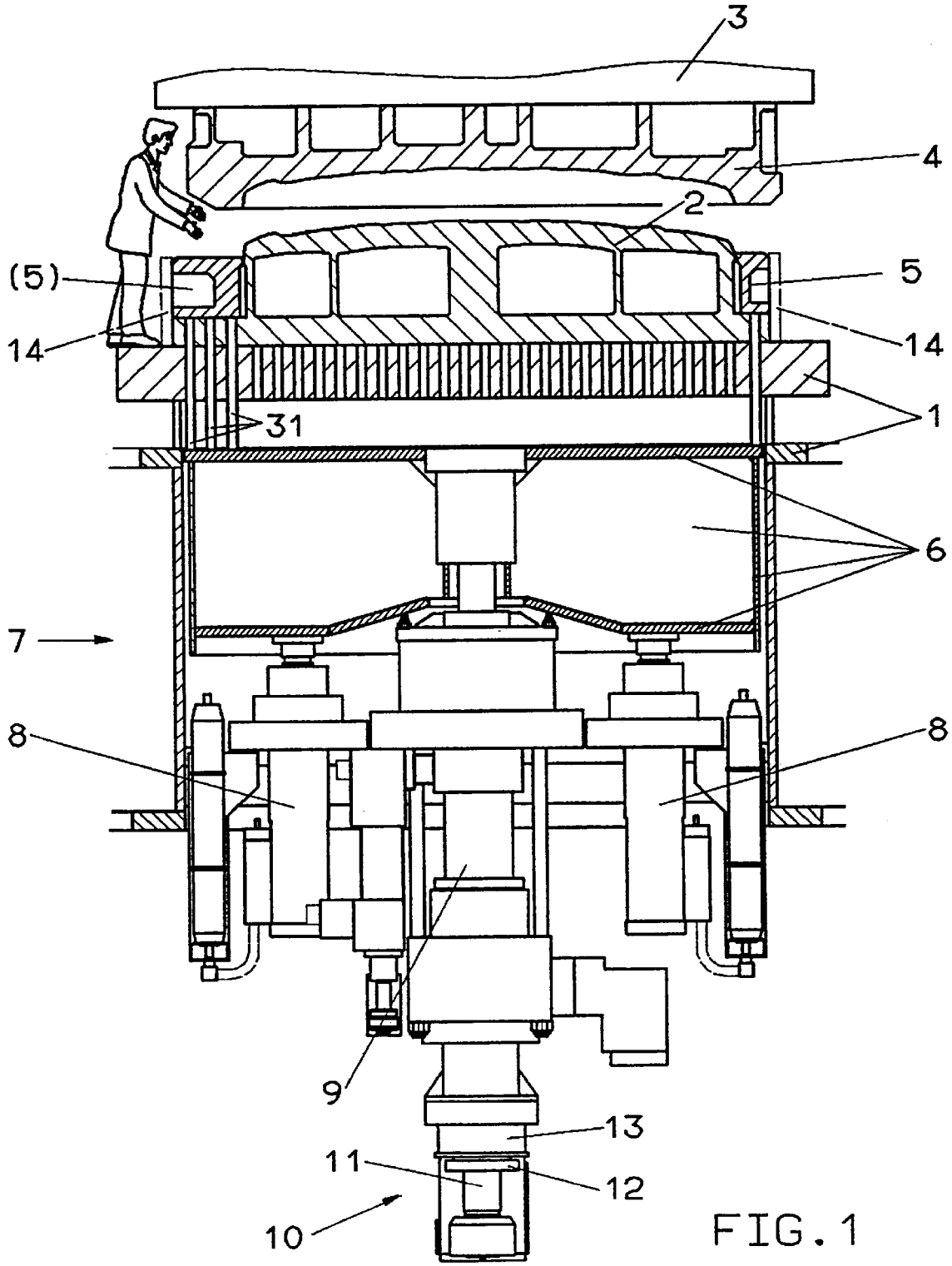
FIG. 1 is a cross-sectional elevational view of an installation space of a known press with a tool and a drawing apparatus.

FIG. 1 illustrates the bedplate 1 of a press, for example, of an installed press, at which tools and grippers are moved in and adjusted. A tool bottom part 2 is placed on the bedplate and locked. A tool top part 4 is fastened on a press slide 3 which can be moved up and down. The tool bottom part 2 has a blank holder 5 which is used for the edge holding of an inserted metal sheet and for the ejection of the then formed metal sheet. For this purpose, the blank holder 5 is acted upon on its underside by studs 31 which are supported on a pressure cheek 6 which can be lifted and lowered in the bedplate. The pressure cheek 6 is part of a drawing apparatus which, overall, is designated by the reference numeral 7.

Drawing cylinders 8, at least one ejector cylinder or move-up cylinder 9 as well as a stop device 10 for the move-up stop, pressure accumulators, pressure lines, valves and the like for controlling the movement of the pressure cheek and the blank holder are integrated in the drawing apparatus. The piston rod 11 of the ejector cylinder which leads out in the downward direction is partially constructed as a spindle onto which a spindle nut 12 is rotatably placed. The spindle nut interacts as a stop with a part 13 fixed on the frame in order to limit the ejector movement in the upward direction.

As the result of a leakage in the pressure lines and valves of the control of the drawing apparatus in FIG. 1, the danger of an undesirable lowering of the blank holder 5, on the one hand, and of an unintentional lifting of the blank holder 5, on the other hand is present. This results in the possibility of injury to the operator between the blank holder 5 and the bedplate 1 or the tool bottom part 2, and, on the other hand, between the blank holder 5 and the tool top part 4 during press stoppage. Up to now, the first danger area was protected merely by protective plates, as indicated by reference numeral 14. The danger between the blank holder 5 and the tool top part 4 area continues to represent a considerable danger source.

Figure 2:
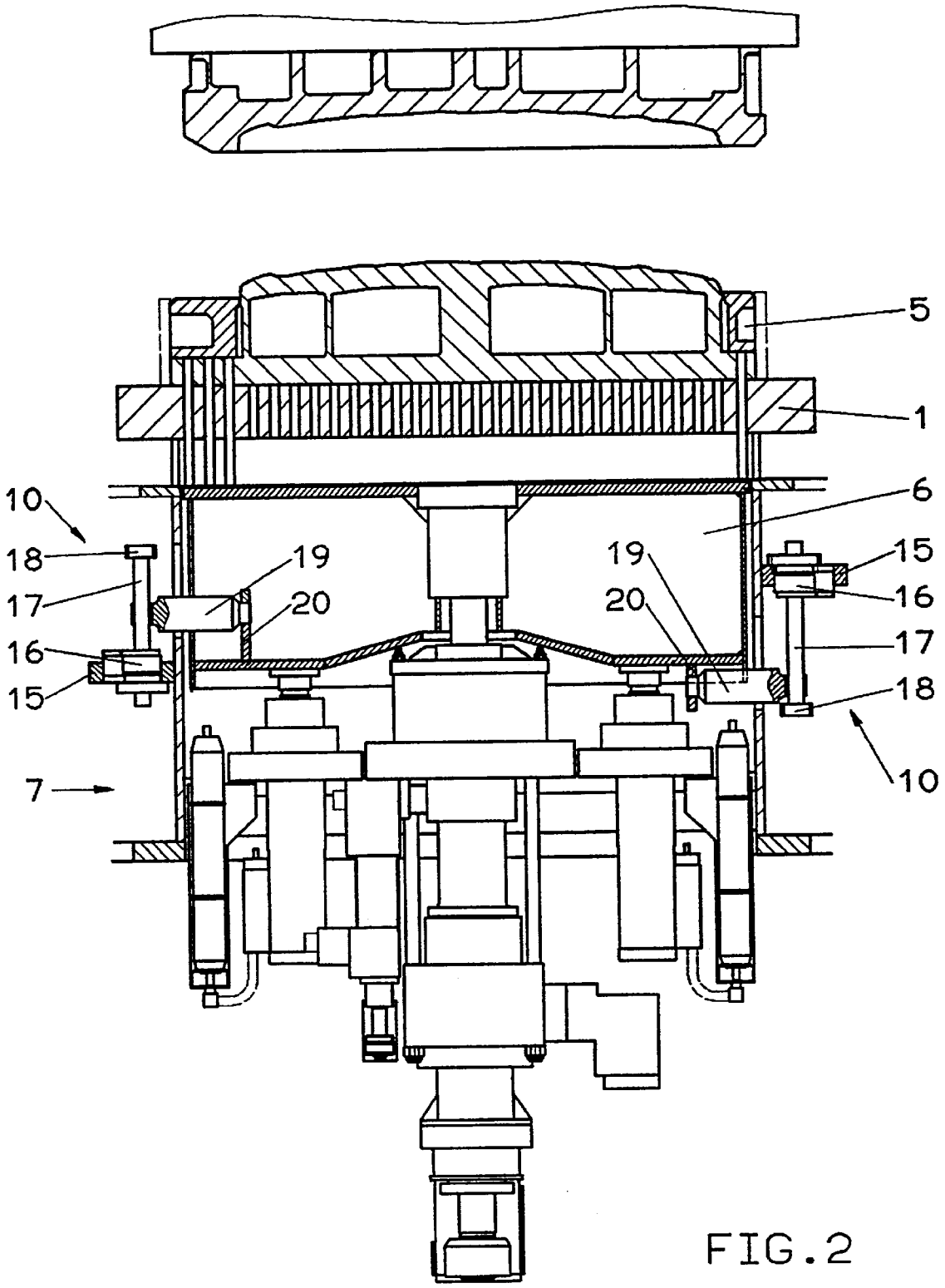
FIG. 2 is a cross-sectional elevational view of the installation space with a device according to the present invention in a position releasing the pressure cheek.
Figure 3:
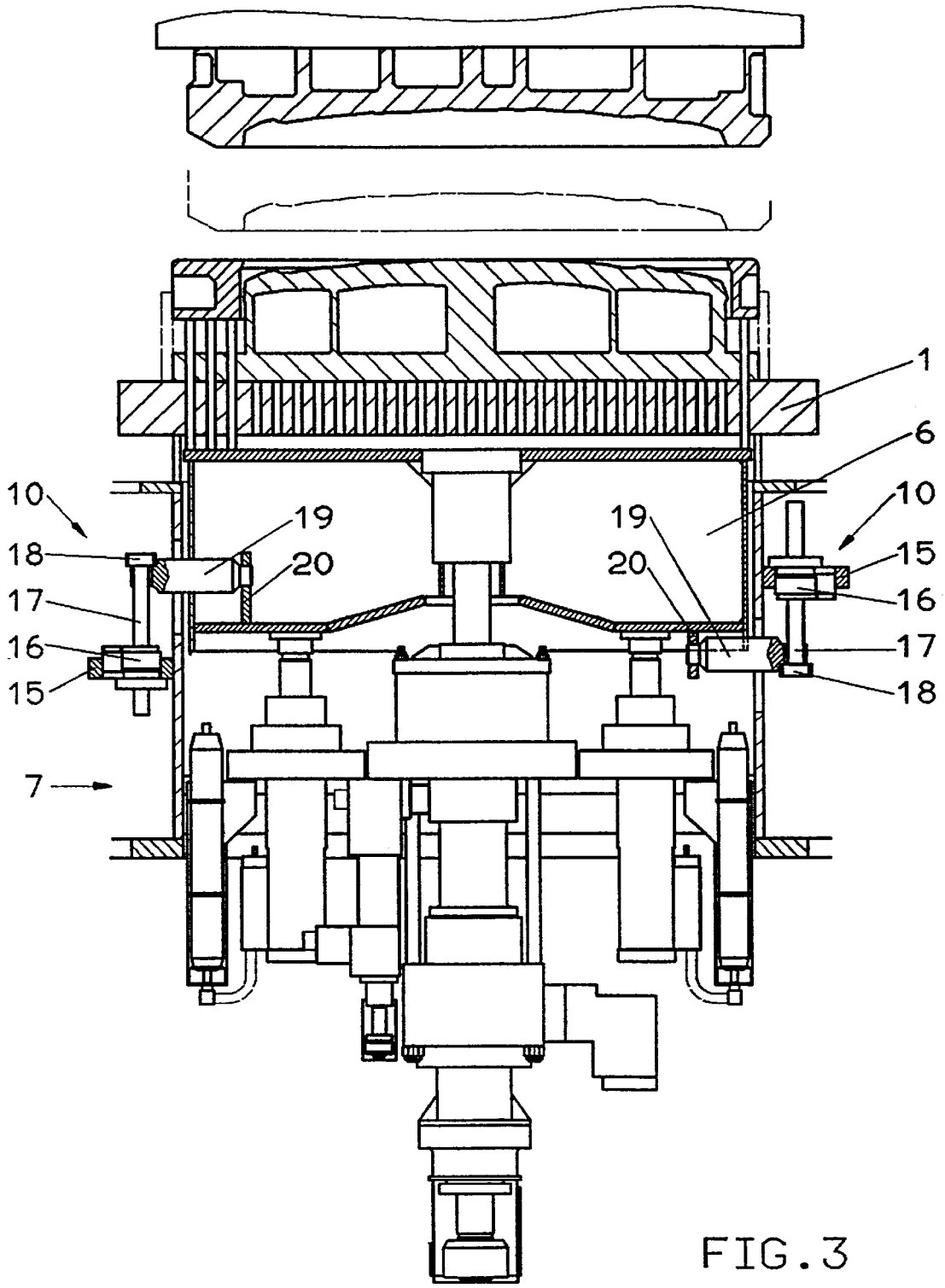
FIG. 3 is a cross-sectional view of the installation space with a device according to the present invention similar to FIG. 2 but with the effect of blocking the pressure cheek in its movement.

In the other figures, the same parts have the same references numerals as far as required for identifying them. FIGS. 2 and 3 show a drawing apparatus 7 with the moved-up pressure cheek 6 (FIG. 2) and the pressure cheek 6 (FIG. 3) blocked in an intermediate position. For this purpose, the bedplate 1 has two motors 16 which are fastened by way of one bearing block 15 respectively and which act upon one spindle 17 respectively. The rotation of the spindles causes a change in their moved-out length.

The spindles can be tensioned and change into a collar 18 in their respective end area. These collars interact with stops 19 which are fastened by lugs 20 on the pressure cheek. The stop device 10 on the left will prevent the pressure cheek 6 from moving up unintentionally and the stop device 10 on the right will prevent the pressure cheek 6 from moving down.

Figure 4:
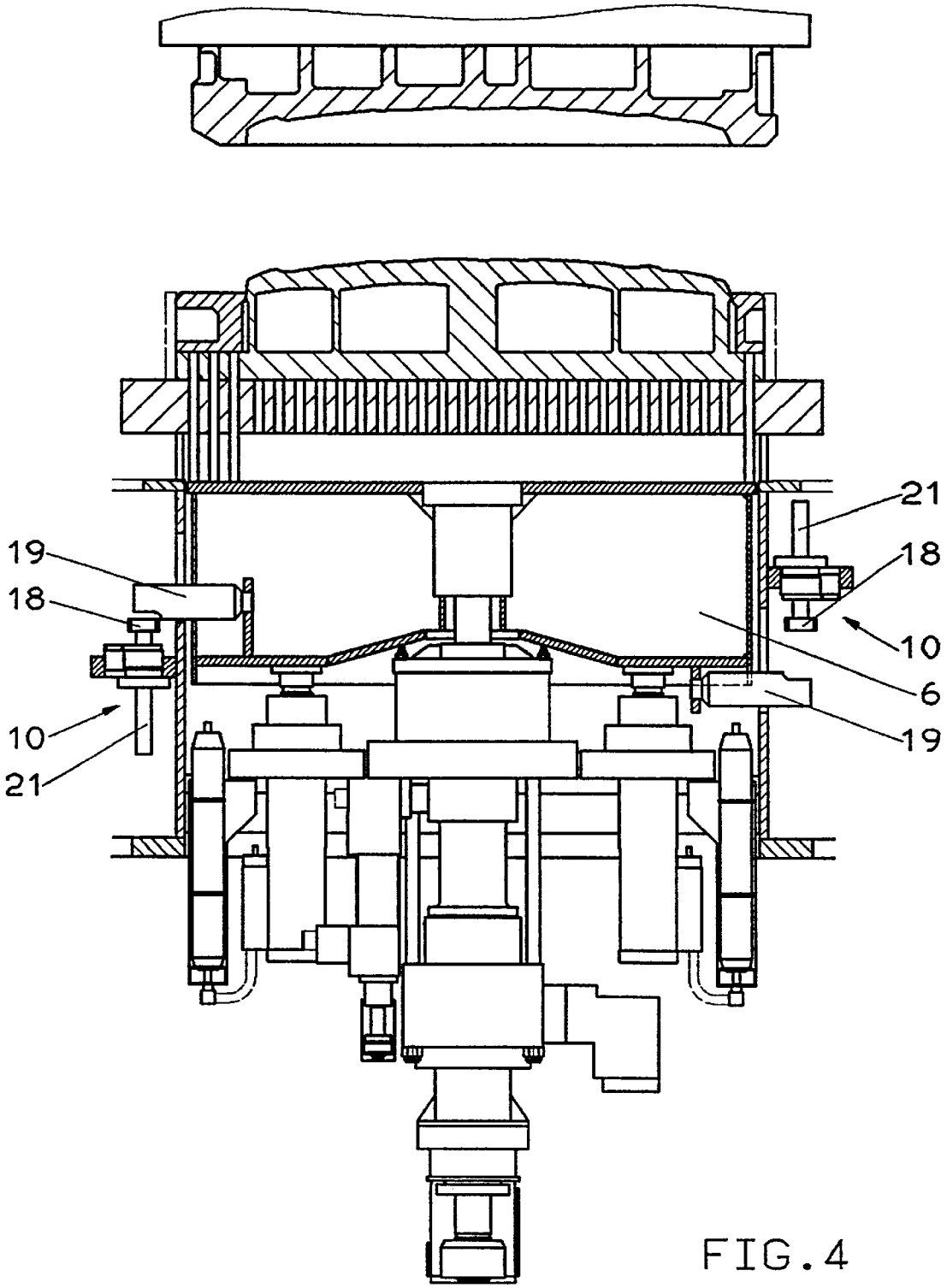
FIG. 4 is a cross-sectional elevational view of the installation space with a second embodiment of the present invention in a position releasing the pressure cheek.
Figure 5:
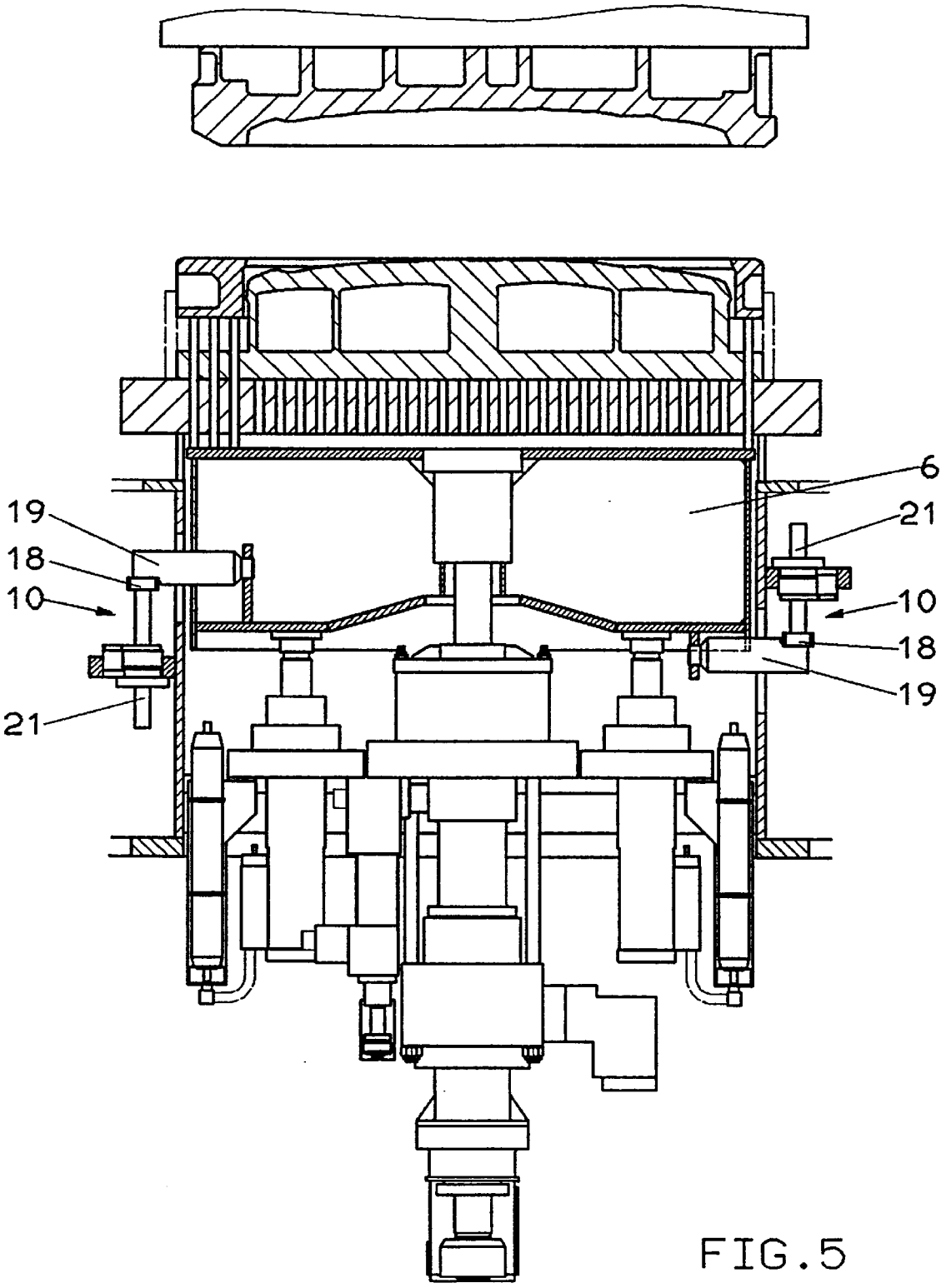
FIG. 5 is a cross-sectional view of the installation space with the second embodiment of the present invention similar to FIG. 4 but with the effect of blocking the pressure cheek in its movement.

FIGS. 4 and 5 show an embodiment which has stop devices 10 which have spindles 21 under pressure. The stops 10, which can be moved along with the pressure cheek 6, can be placed against the collars 18, in which case, according to FIG. 5, a movement of the pressure cheek is prevented while the press is stopped.

Figure 6:
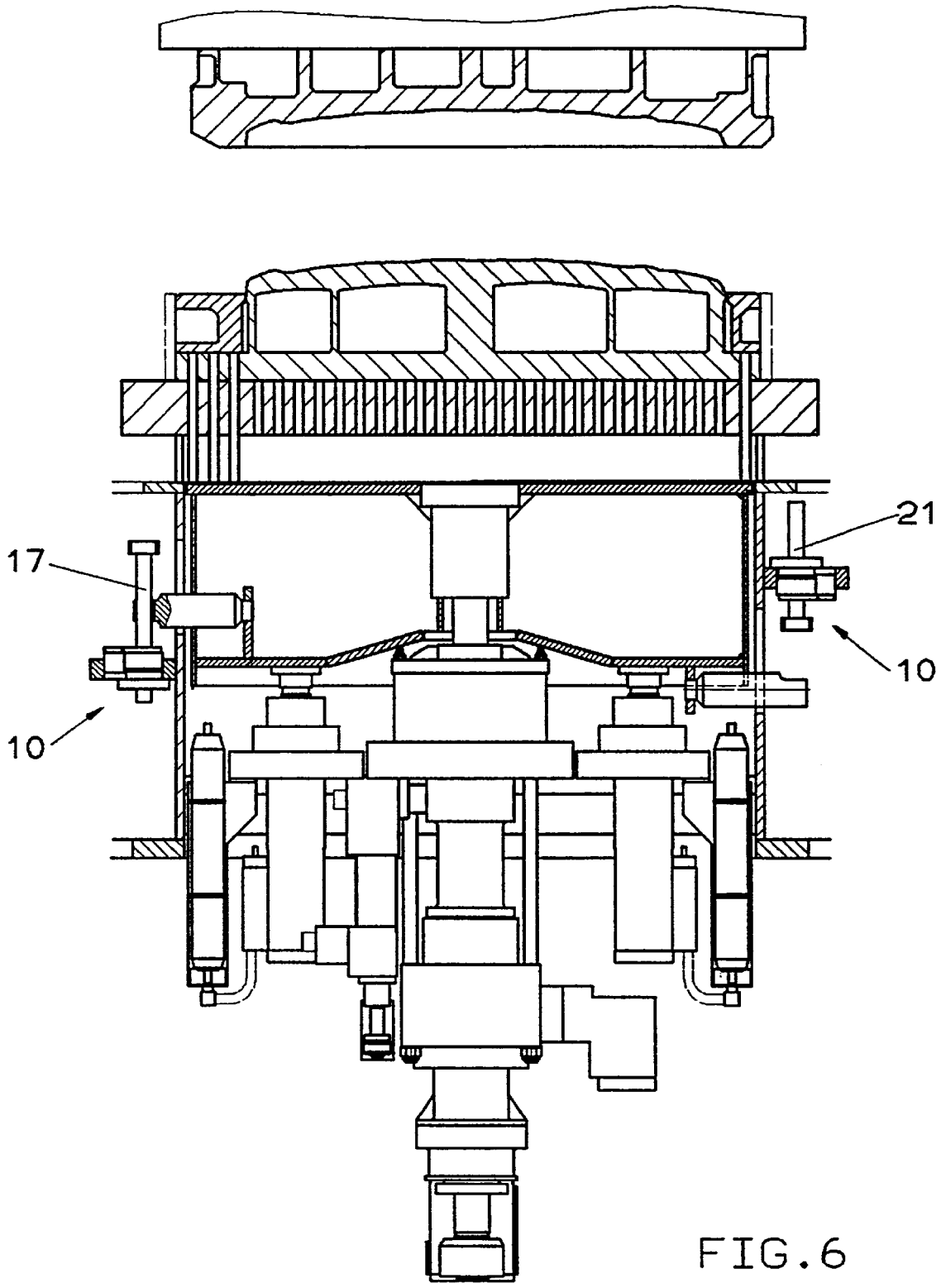
FIG. 6 is a cross-sectional view of the installation space with another embodiment of the present invention involving the features in FIGS. 2 to 5, in which the pressure cheek is freely movable.
Figure 7:
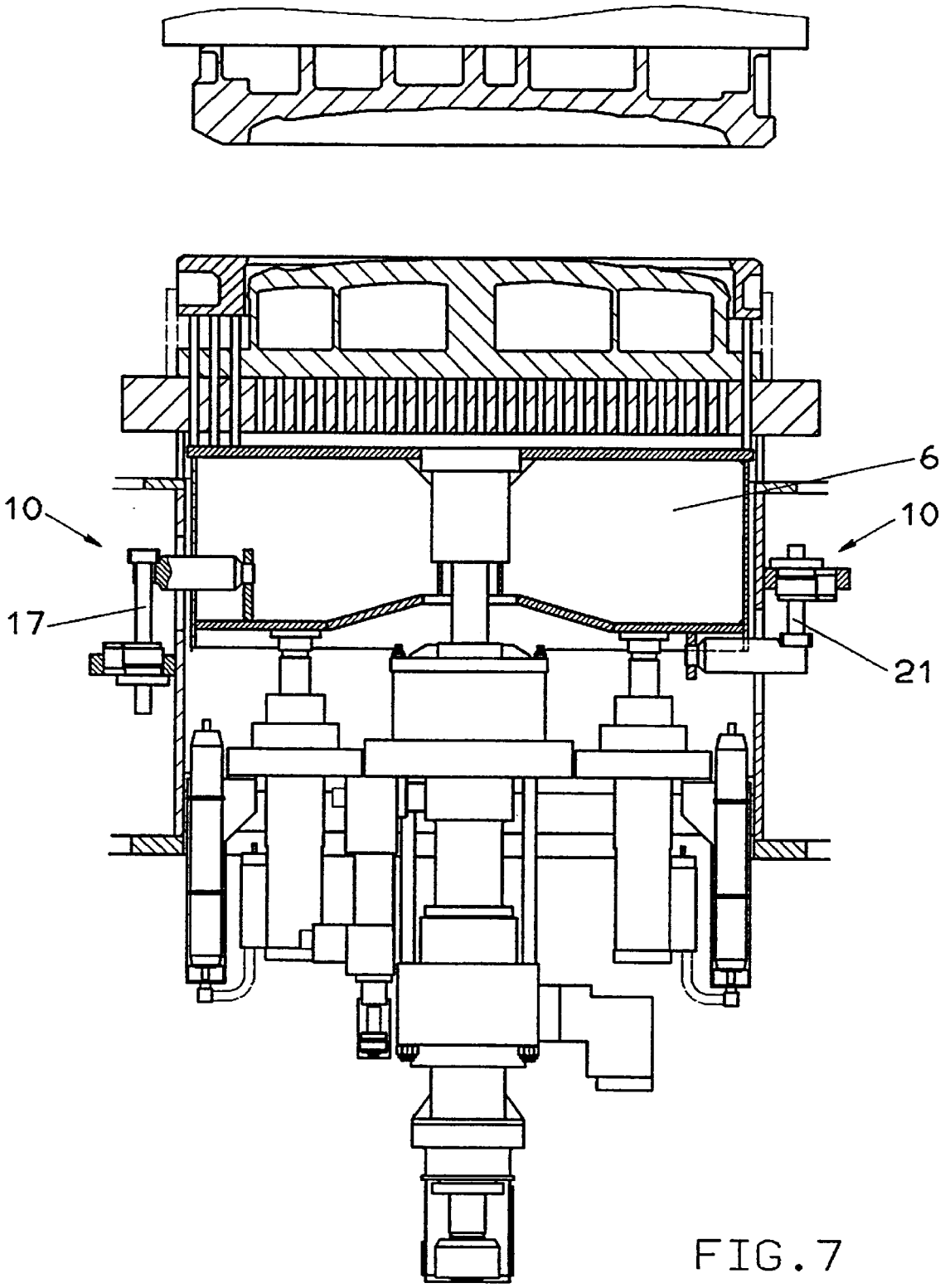
FIG. 7 is a cross-sectional view of the installation space with a mixed solution similar to FIG. 6 but with an effect which blocks the pressure cheek.

FIGS. 6 and 7 show stop devices 10 in a "mixed" form. While the spindle 17 according to the embodiment of FIGS. 2 and 3 shown on the left can be tensioned, corresponding to FIGS. 4 and 5, the spindle 21 illustrated on the right can be under pressure. Spindles 17, 21 together prevent a moving-up of the pressure cheek 6.

Figure 8:
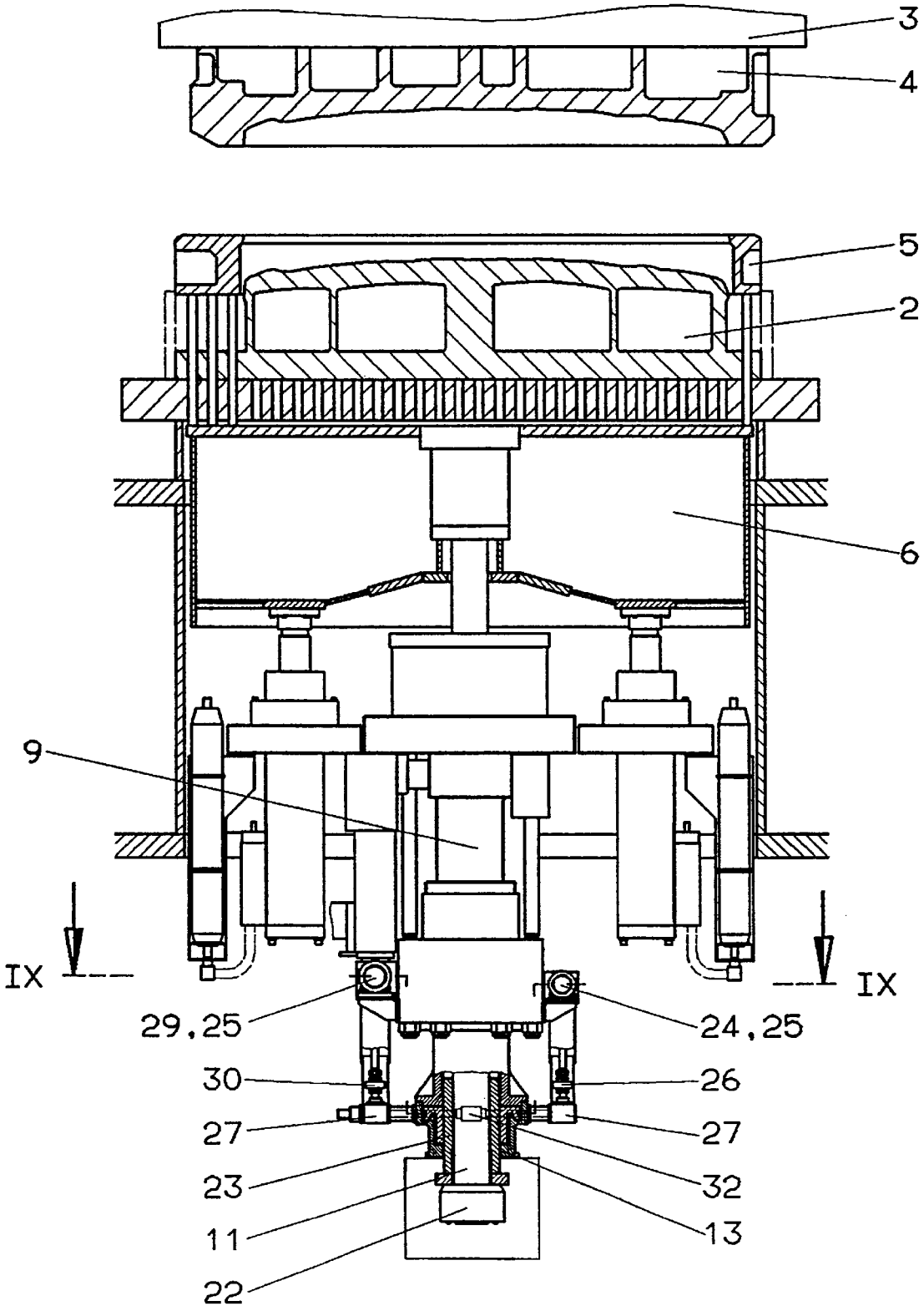
FIG. 8 is a cross-sectional view of the installation space with yet another embodiment of the invention.
Figure 9:
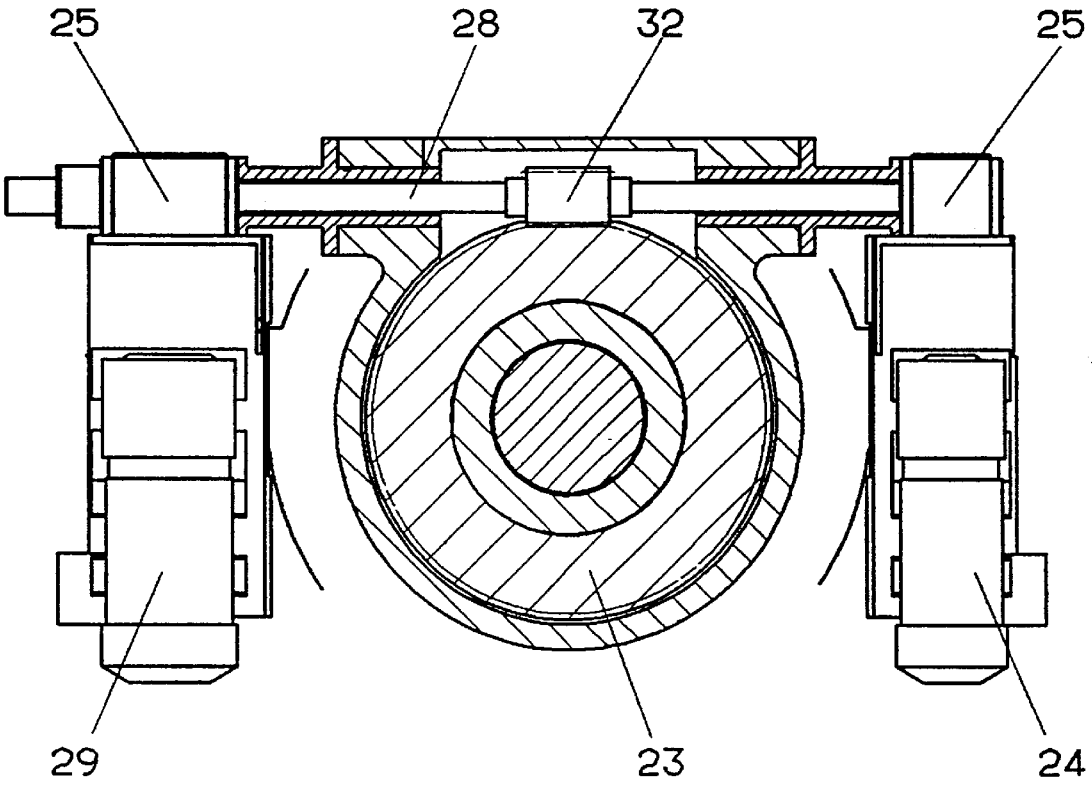
FIG. 9 is a cross-sectional plan view along line IX—IX in FIG. 8.

FIGS. 8 and 9 show another embodiment of the present invention. After the slide 3 has moved down, the pressure cheek 6 can be brought into the upper position by ejector cylinders 9. In the upper position, another sheet metal part can be placed in the tool 2, 4 on the blank holder 5. The level of the pressure cheek 6 and, together therewith, the level of the blank holder 5, is adjusted in a known manner by way of a stop 22 and a spindle sleeve 23 which is rotationally driven in a part 13 fixed on the frame. The stop 22 is situated on the end area of the piston rod 11 of the ejector cylinder 9, which piston rod 11 leads out in the downward direction. A motor moves the spindle sleeve 23 more or less far downward out of the frame-side part.

According to the present invention, the stop 22 and the spindle sleeve 23 are also utilized for avoiding a moving-up of the pressure cheek 6 and the blank holder 5 while the press is stopped. For adjusting the height, a first motor 24 acts upon a worm shaft 28, for example, by way of a first bevel gearing 25, an additional first shifting coupling 26 and another bevel gearing 27. The worm 32 fastened on the worm shaft interacts with the spindle sleeve 23 rotating the latter. For a high-speed rotating of the spindle sleeve, a second motor 29 acts upon the worm shaft 28 by way of first and second bevel gearings 25, 27 and a second shifting coupling 30. The shifting couplings are optionally shifted in the sense of an action upon the motors 25.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Drawing apparatus, in a forming system, comprising at least one pressure cylinder, a pressure cheek, a blank holder supported by the pressure cheek and arranged to be acted upon by the at least one pressure cylinder, wherein one of blocking devices and detents act directly onto the pressure cheek or indirectly onto the pressure cheek via an articulated mechanism selectively to maintain the pressure cheek in a secured position and thereby protect personnel from unintended movement of the pressure cheek, further comprising two fixed stops on the pressure cheek or parts moved thereby, and two motor-driven spindles, of which a first spindle, on an end area thereof away from at least one driving device, is provided with a collar, during an upward movement, to be placed behind a first fixed stop, and of which the second spindle, on an end area thereof away from the at least one driving device, is configured with the collar which, during a downward movement, is arranged to be placed behind a second fixed stop.

2. Drawing apparatus according to claim 1, wherein the at least one driving devices for the spindle with respect to the collar is arranged on sides facing away from the fixed stop.

3. Drawing apparatus according to claim 1, wherein the driving device for the spindle with respect to the stop are arranged on sides facing the stop.

* * * * *